United States Patent [19]

MacDonald et al.

[11] Patent Number: 4,754,840

[45] Date of Patent: Jul. 5, 1988

[54] LEVELING ASSEMBLY FOR WORK PLATFORMS ON ARTICULATING BOOMS

[75] Inventors: Wayne P. MacDonald, McConnellsburg; Jeffery J. Ritz, Warfordsburg, both of Pa.

[73] Assignee: JLG Industries, Inc., McConnellsburg, Pa.

[21] Appl. No.: 105,724

[22] Filed: Oct. 7, 1987

[51] Int. Cl.[4] ..... B66F 11/04

[52] U.S. Cl. ..... 182/2; 182/141

[58] Field of Search ..... 182/2, 141, 148, 127

[56] References Cited

U.S. PATENT DOCUMENTS

| | | | |
|---|---|---|---|
| 2,606,078 | 8/1952 | Brock . | |
| 2,666,417 | 1/1954 | Harsch . | |
| 2,724,620 | 11/1955 | Johnson et al. . | |
| 3,252,541 | 5/1966 | Thorton-Trump . | |
| 3,462,103 | 8/1969 | Strom | 182/2 |
| 3,695,474 | 10/1972 | Blakely . | |
| 3,809,180 | 5/1974 | Grove | 182/2 |
| 3,828,939 | 8/1974 | Tranchero . | |
| 3,866,713 | 2/1975 | Carpenter | 182/2 |
| 3,891,056 | 6/1975 | Ashworth | 182/2 |
| 4,206,833 | 6/1980 | Goyarts . | |
| 4,331,215 | 5/1982 | Grove | 182/2 |
| 4,359,137 | 11/1982 | Merz | 182/2 |
| 4,537,281 | 8/1985 | Endres | 182/2 |

*Primary Examiner*—Reinaldo P. Machado

*Attorney, Agent, or Firm*—Foley & Lardner, Schwartz, Jeffery, Schwaab, Mack, Blumenthal & Evans

[57] ABSTRACT

An apparatus for retaining the attitude of a platform on an articulated boom is provided. The apparatus includes master-slave piston cylinders for adjusting the attitude of the platform relative to a reference object. The apparatus further includes a pivot plate defining a triangle having first, second, and third mounting locations with a platform being pivotally mounted to the pivot plates at one mounting location. A piston cylinder is pivotally connected to the pivot plates at a second mounting location and is operatably connected to the platform. A pivot means is pivotally connected to the pivot plate at the third mounting location and, at its other end, is connected to the fixed support about which the articulating boom rotates. Rotation of the articulating boom results in the pivot means pivoting the pivot plate in such a way that the platform is maintained at its preset orientation.

16 Claims, 2 Drawing Sheets

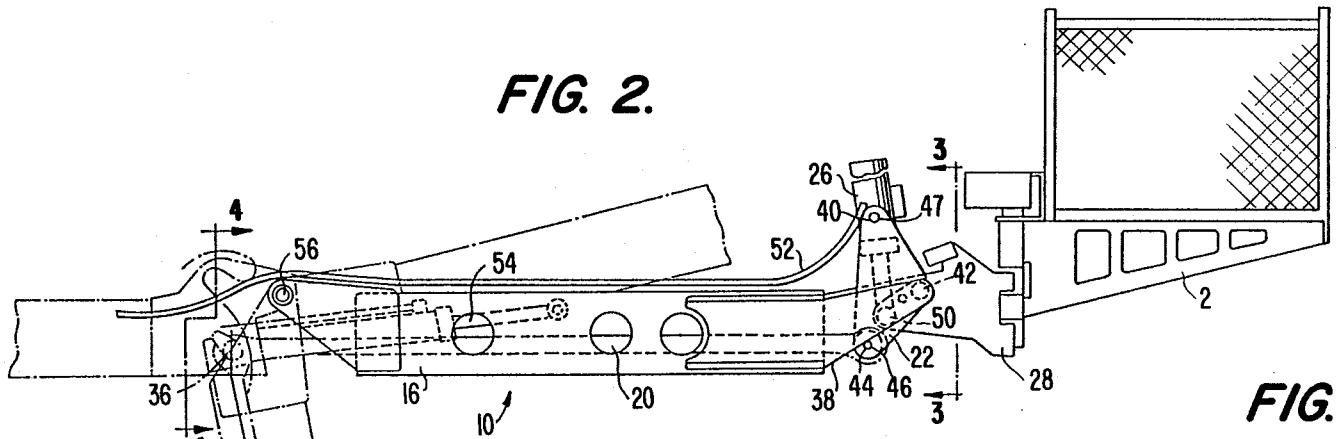
FIG. 2.
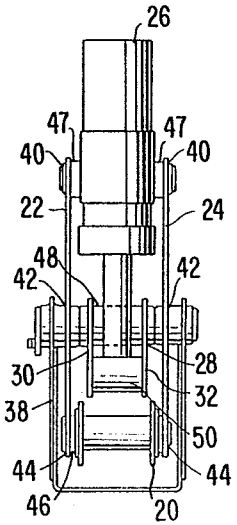
FIG. 3.
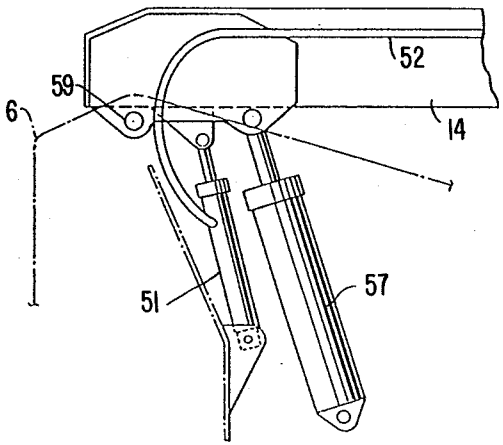
FIG. 5.
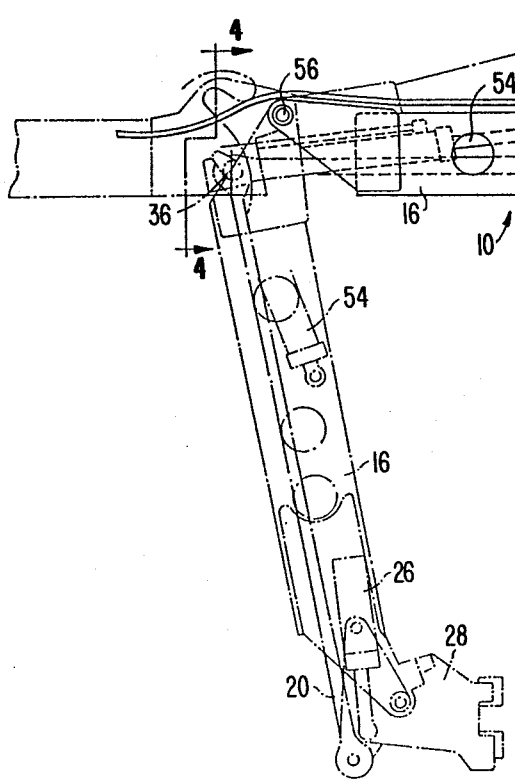

LEVELING ASSEMBLY FOR WORK PLATFORMS ON ARTICULATING BOOMS

BACKGROUND OF THE INVENTION

The present invention relates as indicated to an apparatus for retaining the attitude of a platform on an articulated boom, and relates more particularly to an apparatus which maintains the platform at a predetermined attitude relative to a fixed support while the articulating boom is raised or lowered. The apparatus of the present invention retains the predetermined platform attitude without the need for any operator intervention during the raising and lowering of the articulating boom. Additionally, the apparatus permits easy readjustment of the predetermined platform attitude.

Elevatable platforms for elevating workers to various work sites such as telephone lines or fruit-bearing trees, are commonly used. These platforms are typically elevated by a hydraulically operated boom or crane assembly. The boom assembly generally includes a support boom and an articulating boom hinged to the support boom whereby the articulating boom can be pivoted relative to the support boom so as to raise or lower the attached platform.

Undesirable consequences can occur if the platform is fixed relative to the main boom since the attitude of the platform will change correspondingly as the articulating boom changes its orientation relative to the support boom. In the case where the platform is occupied by a worker, injury could result if the worker cannot maintain his footing on the tilting platform bottom. Even if the platform is not occupied by a worker, injury to those on the ground can occur if materials or heavy objects are spilled or thrown from the tilting platform.

A number of solutions to the problem referred to above have been proposed. Judged against the important criteria of cost, reliability and ease of operation, however, the existing solutions have still left room for improvement. Additionally, none of the existing solutions have satisfactorily addressed the problem of maintaining the platform attitude while both the support boom and the articulating boom are independently moved. While apparatuses have been proposed in which the attitude of the platform can be adjusted relative to either the support boom or the articulating boom, there has heretofore not existed a reliable, practical apparatus which adjusts the platform attitude while both booms are simultaneously moving.

An analysis of several existing apparatuses reveals the deficiencies of these apparatuses in maintaining platform attitude when both the support boom and the articulating boom are moving. U.S. Pat. No. 3,828,939 to Tranchero illustrates a crane for raising and lowering a work platform and using a parallelogram arrangement to retain the horizontal attitude of the bottom plane of the platform. Although the apparatus disclosed in Tranchero maintains the platform at a horizontal orientation without any operator intervention, the apparatus has several disadvantages. For example, no mechanism for changing the orientation of the platform from a horizontal orientation to another orientation is provided. Also, the lever parallelogram arrangement precludes the use of a boom which can be telescoped to increase its length.

Several devices using a master-slave cylinder arrangement have also been proposed to maintain the orientation of an aerial platform. These devices include a slave cylinder operatively connected to the platform which extends or retracts in correspondence with the extension or retraction of a master cylinder. For example, U.S. Pat. No. 3,866,713 to Carpenter et al discloses an apparatus for extending an operator platform having a master cylinder connected between the articulating boom and the support boom. A slave cylinder is connected at one end to the fly end of the articulating boom and connected at its other end to the platform. The master and slave cylinders are interconnected in a closed circuit such that extension and retraction of the master cylinder effects corresponding retraction and extension of the slave cylinder. However, Carpenter does not disclose an arrangement for maintaining the platform orientation while both the support boom and the articulating boom move independently. Separate master cylinders would be required to track the independent movements of each boom and an appropriate slave cylinder arrangement would be required to produce corresponding movement of the platform in response to the movement of each master cylinder. Applicants are unaware of arrangements in which multiple master cylinders are connected to a single slave cylinder. Presumably this is because the relationship of cylinder length to boom angle is a cosine function rather than being linear. As a result, with independently operated booms, the platform leveling slave cylinder is easily unsynchronized.

SUMMARY OF THE INVENTION

The principal objects of the present invention are to provide an apparatus which reliably and automatically maintains the attitude of a platform or implement on an elevatable articulating boom during movement of the articulating boom and the support boom; to provide an apparatus which is of a simple, relatively inexpensive construction; to provide an apparatus which can be rapidly and safely installed on existing articulating booms, and to provide an apparatus which maintains the attitude of a platform or implement without the need for sensors, switches, chains, cables, gears or other devices susceptible to failure or maladjustment.

In accordance with the invention, the platform attitude control apparatus comprises a link positioned in or adjacent to the articulating boom and extending the longitudinal length of the boom, a pivot plate having three mounting locations disposed in a triangle on the plate, with the plate thus serving to interconnect the link, the platform, and the boom. One end of the link is connected to the support boom and the other end is connected to one of the three mounting locations on the pivot plate. Due to the triangular arrangement of the mounting locations of the pivot plate, the pivot plate is a linkage which acts through the attitude setting means to pivot the platform so that it retains its present orientation.

In the preferred embodiment, the means for setting the attitude of the platform is a hydraulic cylinder mounted at its barrel end to one of the three mounting locations on each of two pivot plates, and mounted at the end of its rod to a flange integral with the platform. A single pivot plate could also be provided and arranged in the same manner.

The components of the apparatus can be easily installed on the boom and the platform. The through hole at the fly end of the boom at which the platform is normally attached is used as a through hole for supporting a pin which mounts the pivot plate. The apparatus of the present invention does not reduce the extension capability of the boom nor does it hinder the vision or reach of a worker on the platform.

A further advantage of the invention is that the apparatus operates independently of any power system used to swivel or raise and lower the boom.

These and other objects of the invention will be apparent as the following description proceeds in particular reference to the application drawings.

BRIEF DESCRIPTION OF THE DRAWINGS

FIG. 2 is a side elevational view of the articulating boom of a first embodiment with the boom also shown in lowered positioned by dot-dash lines;

FIG. 3 is an end view of the first embodiment taken along line 3—3 of FIG. 2;

FIG. 5 is a side elevational view of the base end of the support boom, with the ground control station being shown in dot-dash lines.

DETAILED DESCRIPTION OF THE PREFERRED EMBODIMENT

Figures 1, 4:
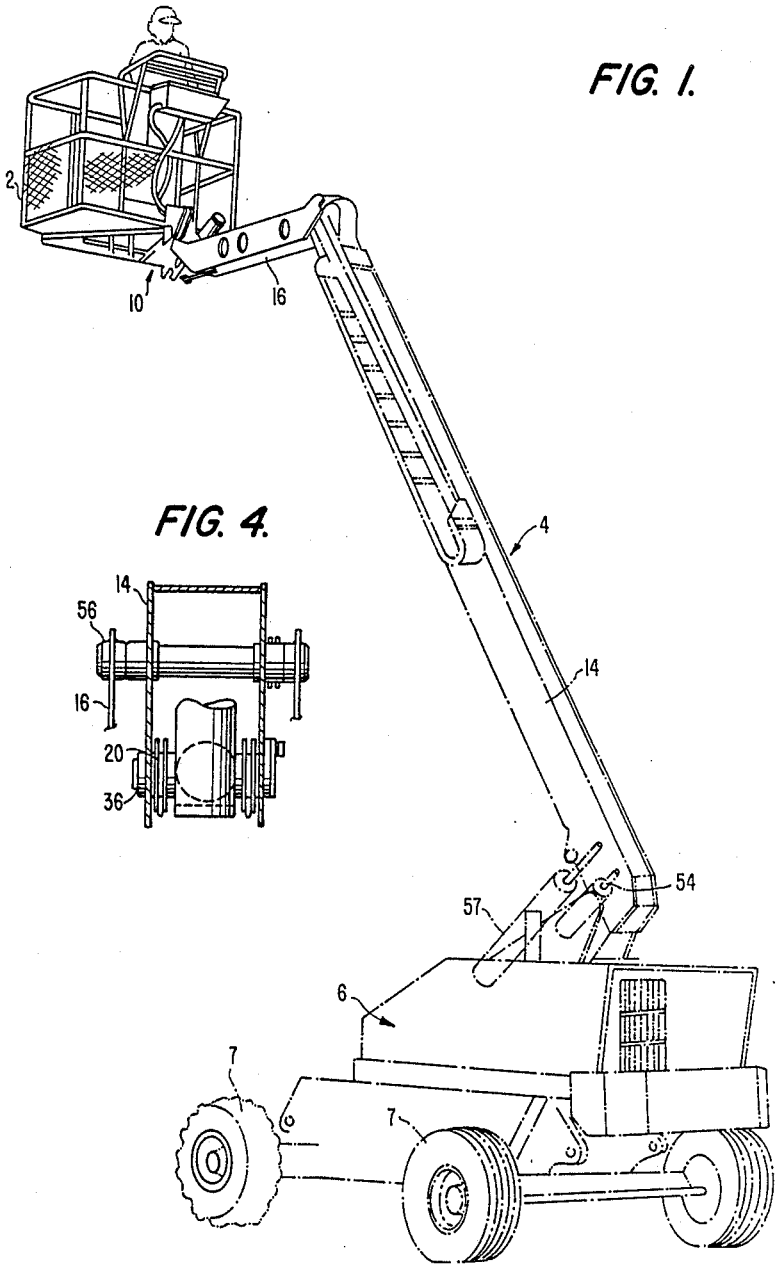
FIG. 1 is a perspective view of the invention mounted on an articulated boom in turn supported on a ground control station, with the station and articulating boom being shown in dashed lines.
FIG. 4 is a sectional view of the articulating boom taken along line 4—4 of FIG. 2.

Referring to FIG. 1, a work platform generally indicated at 2 is supported by a boom assembly generally indicated at 4 pivotally mounted on a ground support station generally indicated at 6. The latter is provided with tires 7 to provide mobility to the entire apparatus and permit the same to be transported to various and typical work sites such as telephone line repair sites, indoor or outdoor maintenance locations, and others too numerous to mention.

The ground control station 6 is shown in dashed lines since the details thereof form no part of the present invention. The boom assembly 4 is also partially shown in dashed lines for the same reason, with the boom assembly comprising a support boom 14 and an articulating boom 16. In a well-known manner, power is supplied through the boom assembly 4 to the work platform to permit movement of the platform either by the ground control station or by the worker positioned in the platform.

Positioned between the articulating boom 16 and the platform 2 is a platform leveling assembly forming the present invention, generally indicated at 10 and shown only schematically in FIG. 1. The present invention is directed to this leveling assembly which permits the platform to be maintained at a predetermined angle relative to the ground control station 6. Although this angle may be such that the attitude of the platform is horizontal or near horizontal, it will be understood that the term leveling is intended to mean any angle or attitude at which the work platform is originally positioned and subsequently maintained regardless of the position or angle of the support boom.

Referring to FIGS. 2–4, the assembly 10 comprises a link 20, a pair of pivot plates 22, 24, a piston-cylinder 26, and a flange assembly 28. Flange assembly 28 comprises a pair of flange plates 30, 32 spaced apart and fixedly connected to one another. The free ends of flange plates 30, 32 are fixedly connected to the platform 2.

The components of the apparatus 10 are variously connected to platform 2, articulating boom 16 and support boom 14, and operate together so that platform 2 maintains a given orientation with respect to a reference position during movement of articulating boom 16 relative to support boom 14. Specifically, one end of link 20 is pivotally connected to support boom 14 by a pin 36. Link 20 extends longitudinally through the partially open articulating boom 16 and terminates adjacent the fly end 38 of articulating boom 16. The end of link 20 is connected to pivot plates 22, 24 in a manner to be presently described. Although link 20 is described and illustrated as positioned within the articulating boom 16, it will be understood that link 20 could be positioned outside the articulating boom 16 as well.

Each pivot plate 22, 24 is provided with three mounting holes 40, 42 and 44. A pivot pin 46 is retained in mounting hole 44 and pivotally secures link 20 to pivot plates 22, 24. A pair of pins 47 are pivotally mounted in respective mounting holes 40 of pivot plates 22, 24 and each pin is connected to a respective side of the barrel end of the piston cylinder 26 which functions to set the angle of the platform as explained below. A piston rod extends into a pin 50 for connecting the piston cylinder 26 to flange plates 30, 32. A pin 48 is pivotally mounted in anti-friction brushings (not shown) in flange plates 30, 32. The ends of pin 48 each extend axially beyond each respective flange plate 30, 32 and through anti-friction bushings (not shown) in respective pivot plates 22, 24 to be rotatably received in respective sides of fly end 38 of boom 16.

With regard to the power assembly for pivoting support boom 14 relative to ground support station 6, a hydraulic cylinder 57 is provided with its rod end mounted near the lower portion of support boom 14 and its barrel end operatively connected to ground support station 6. Hydraulic cylinder 57 is operated in a known manner to pivot support boom 14 which is pivotally connected to ground support station 6 by a pin 59. A master cylinder 51 is also provided with its rod end mounted to the lower portion of support boom 14 and its barrel end rotatably connected to ground support station 6. Master cylinder 51 is operatively connected through hoses 52 with piston cylinder 26 so that extension or retraction of the rod of master cylinder 51 produces corresponding retraction or extension of the rod of piston cylinder 26. Master cylinder 51 does not bear any of the weight of boom assembly 4 but is instead provided to produce corresponding extension or retraction of piston cylinder 26 so that platform 2 is maintained at a predetermined attitude.

With regard to the power assembly for pivoting articulating boom 16 relative to support boom 14, a hydraulic cylinder 54 is provided with its barrel end mounted near the upper end of support boom 14 by pin 36 and with its rod end pivotally connected to articulating boom 16. Thus, pin 36 connects cylinder 54 to the support boom 14 in addition to connecting link 20 to the support boom 14. A pin 56 pivotally connects articulating boom 16 to support boom 14.

Link 20, pivot plates 22, 24, piston cylinder 26 and flange assembly 28 comprise a linkage which maintains platform 2 in a predetermined orientation during elevation or lowering of articulating boom 16. Master cylinder 51, hoses 52, piston cylinder 26 and flange assembly 28 operate together to maintain the predetermined orientation of platform 2 when the support boom 14 pivots relative to ground support station 6. Apparatus 10 maintains the orientation of platform 2 without the need for interrelated hydraulic actuators connected between each boom and the platform or other relatively complex systems, such as an electronically guided system. Furthermore, the design of apparatus 10 allows it to be easily installed on preexisting articulating boom and platform assemblies.

Moreover, apparatus 10 has only one component which must be connected to a power source, that being piston cylinder 26. Otherwise, apparatus 10 is designed to operate from the pivoting movement of articulating boom 16 and requires no power take-off or other separate power supply.

The operation of apparatus 10 is as follows. The orientation of platform 2 with respect to a predetermined reference position, such as, for example, the ground or the object to which the platform 2 is to be elevated, is selected, and piston cylinder 26 is activated to move platform 2 to the predetermined orientation. Activation of piston cylinder 26 is accomplished in a known manner. While it may be desirable in some circumstances to preset the orientation of platform 2 with respect to a reference position before the platform is elevated or lowered, the orientation of platform 2 can be reset or adjusted at any time merely by actuating piston cylinder 26. Since the barrel end of piston cylinder 26 is pivotally connected to pivot plates 22, 24, extension or retraction of the rod of cylinder 26 causes pin 50 and flange assembly 28 to pivot around pin 48. Thus, the orientation of platform 2 is preset by pivoting the platform relative to flange plates 22, 24 until the desired preset orientation is achieved. Hydraulic cylinder 57 is appropriately controlled to pivot support boom 14 upwardly relative to ground support station 6; that is, pivoting movement is produced by selectively extending the piston rod of cylinder 57. The relatively much larger force of cylinder 57 forces master cylinder 51 to extend or retract accordingly.

As can be understood, if cylinder 57 is actuated so as to pivot support boom 14 relative to ground support station 6 while cylinder 54 remains unactuated, the relative orientation of articulating boom 16 and support boom 14 will remain unchanged. The rod of master cylinder 51 extends or retracts as support boom 14 pivots, relative to ground support station 6 and the rod of piston cylinder 26 correspondingly retracts or extends to maintain the predetermined orientation of platform 2.

In addition to movement of support boom 14, cylinder 54 can be appropriately controlled to pivot articulating boom 16 relative to support boom 14. Once cylinder 54 is actuated to pivot articulating boom 16 relative to support boom 14, link 20 is set into operation to maintain platform 2 in its preselected orientation.

For example, with reference to FIG. 2, if cylinder 54 is actuated so that its rod is extended out of its barrel, the fly end 38 of articulating boom 16, as well as the rest of the boom, rotates in a counterclockwise manner around pin 56 connecting articulating boom 16 to support boom 14. The pivoting of the fly end 38 results in clockwise pivoting of pivot plates 22, 24 about pin 51 in the following manner. Since link 20 is of a fixed length and is connected to pivot plates 22, 24 by pivot pin 46, counterclockwise pivoting of articulating boom 16 about pin 56 causes link 20 to constrain pivot pin 46 to rotate clockwise about pin 51. Since pivot pin 46 is mounted in holes 44 of pivot plates 22, 24, the pivot plates 22, 24 rotate about pin 51 as pivot pin 44 rotates around pin 51. The clockwise rotation of pivot plates 22, 24, in turn, causes piston cylinder 26, which is connected to plates 22, 24 by pivot pins 47, to also rotate clockwise about pin 51.

By virtue of the interconnection of flange assembly 28 and piston cylinder 26 by pin 50, flange assembly 28 is caused to rotate clockwise about pin 48 in correspondence with the clockwise rotation of piston cylinder 26. As flange assembly 28 rotates clockwise, the fixedly connected platform 2 moves with it and maintains its predetermined orientation relative to the reference position.

Accordingly, when articulating boom 16 has been pivoted counterclockwise about pin 56 or, in other words, when articulating boom 16 has been elevated relative to support boom 14, apparatus 10 is set in operation to rotate platform 2 clockwise about pin 48 by an amount corresponding to the counterclockwise rotation of articulating boom 16. If necessary, piston cylinder 26 can be actuated before, during or after the pivoting of articulating boom 16 so as to reset the orientation of platform 2 to a new orientation. For example, once articulting boom 16 has been pivoted counterclockwise or upwardly by the desired amount so that platform 2 is adjacent the elevated work place, piston cylinder 26 can be actuated to tilt platform 2 upward or downward by extension or retraction of its rod so that flange assembly 28 pivots about pin 51. Platform 2 is also maintained in its preset orientation when articulating boom 16 is pivoted clockwise about pin 56 or, in other words, when articulating boom 16 is lowered. When articulating boom 16 is lowered, the end of link 20 is caused to extend further beyond fly end 38. Since pin 46 connects the end of link 20 to pivot plates 22, 24, the pivot plates are caused to rotate counter-clockwise about pin 48 as the extension of link 20 beyond fly end 38 increases. The pivoting of pivot plates 22, 24 brings about counterclockwise rotation of piston-cylinder 26. In turn, flange assembly 28 is rotated counterclockwise about pin 48 in correspondence with the lowering of articulating boom 16 so that platform 2 maintains its preset orientation.

It will be apparent to those skilled in the art that departures can be made from the foregoing description and drawings without, however, departing from the spirit of the invention. For example, piston-cylinder 26 can be replaced with another structure which incrementally pivots flange assembly 28 about pin 48 in response to motion of master cylinder 51. Thus, a rotating screw attached to the pivot plates can be selectively advanced or retracted in a threaded receiving apparatus connected to the flange assembly. This would also change the attitude of the platform relative to the articulating boom independently of the movement of the articulating boom.

Additionally, the positioning of the link having one end pivotally mounted on the support boom and one end pivotally mounted on the pivot plates, can be placed along the side of the articulating boom as well as within the articulating boom. Again, the concept is to provide a linkage which responds automatically to movement of the articulating boom to adjust the orientation of the platform, whereby the linkage is easily installed, easily maintained and reliable.

The advantages of the present invention will be readily apparent. A worker or a load of materials in the platform can be elevated to a raised work site without the danger that the worker will lose his or her footing or that the materials will slide off the platform. If desired, the platform can be present in a tilted orientation, such as might be useful to keep certain materials from rolling about the platform. The apparatus of the present invention provides versatility for operating elevatable platforms with a simple construction which is reliably operated in connection with the normal operation of the booms which elevate the platform.

What is claimed is:

1. An apparatus for maintaining the orientation of a platform or other elevatable member relative to a fixed support while the member is raised or lowered relative to the fixed support, the member being mounted on a boom which is pivotally connected to the fixed support and has a fly end, comprising:

pivot plate means defining a triangle having first, second and third mounting locations, each mounting location being disposed relatively adjacent a respective corner of said triangle;

a first mounting means for coaxially pivotally mounting said pivot plate means, the fly end of the boom and said member at said first mounting location;

pivot means pivotally connected at one end to said second mounting location by a second mounting means and at another end to the fixed support, said pivot means being adapted to pivot said second mounting means relative to said first mounting means;

means for adjusting the orientation of said member, comprising a third mounting means for pivotally connecting said adjusting means to said pivot plate means at said third mounting location, said adjusting means being further provided with pin means for pivotally connecting said adjusting means to said member at a location spaced from said third mounting location, whereby said adjusting means interconnects said pivot plate means and the member so that the member pivots about said first mounting location in correspondence with the pivoting of said second mounting means about said first mounting location, said adjusting means being adapted to vary the spacing of said pin means and said third mounting location; and means for pivoting the boom about the fixed support, whereby said pivot means pivots said second mounting means about said first mounting means, and said adjusting means acts to correspondingly pivot the member to maintain its orientation as said second mounting means pivots about said first mounting means.

2. An apparatus as claimed in claim 1, wherein said adjusting means comprises a hydraulic piston having a barrel end and a rod end.

3. An apparatus as claimed in claim 1, wherein said first, second and third mounting means each comprise a pin.

4. An apparatus as claimed in claim 1, and further comprising a second pivot plate.

5. An apparatus as claimed in claim 1, wherein said pivot means comprises a link.

6. An apparatus as claimed in claim 1, wherein said means for pivoting the boom comprises a hydraulic cylinder connected at one end to the fixed support and at another end to the boom.

7. A boom assembly for a platform or the like, comprising:

an articulating boom for raising and lowering said platform relative to a fixed support, said boom having a fly end and an opposed end;

pin means for pivotally connecting said opposed end of said boom to said fixed support;

pivot plate means defining a triangle having first, second and third mounting locations, each mounting location being disposed relatively adjacent a respective corner of said triangle;

first mounting means for coaxially pivotally mounting said pivot plate means, the fly end of the boom and said platform at said first mounting location;

pivot means pivotally connected at one end to said second mounting location by a second mounting means and at another end to the fixed support, said pivot means being adapted to pivot said second mounting means relative to said first mounting means;

means for adjusting the orientation of said platform, comprising a third mounting means for pivotally connecting said adjusting means to said pivot plate means at said third mounting location, said adjusting means being further provided with pin means for pivotally connecting said adjusting means to said platform at a location spaced from said third mounting location, whereby said adjusting means interconnects said pivot plate means and the member so that the member pivots about said first mounting location in correspondence with the pivoting of said second mounting means about said first mounting location, said adjusting means being adapted to vary the spacing of said pin means and said third mounting location; and means for pivoting the boom about the fixed support, whereby said pivot means pivots said second mounting means about said first mounting means, and said adjusting means acts to correspondingly pivot the platform to maintain its orientation as said second mounting means pivots about said first mounting means.

8. An apparatus as claimed in claim 7, wherein said adjusting means comprises a hydraulic piston having a barrel end and a rod end.

9. An apparatus as claimed in claim 7 wherein said first, second and third mounting means each comprise a pin.

10. An apparatus as claimed in claim 7, wherein said pivot plate means comprises a first and a second pivot plate.

11. An apparatus for maintaining the orientation of a platform or other elevatable member relative to a fixed support while the member is raised or lowered relative to the fixed support, the member being mounted on a first boom which is pivotally connected to a second boom which is pivotally connected to the fixed support, the first and second booms each having a boom end and a fly end, comprising:

pivot plate means defining a triangle having first, second and third mounting locations, each mounting location being disposed relatively adjacent a respective corner of said triangle;

a first mounting means for coaxially pivotally mounting said pivot plate means, the fly end of the first boom and said member at said first mounting location;

pivot means pivotally connected at one end to said second mounting location by a second mounting means and at another end to the fixed support, said pivot means being adapted to pivot said second mounting means relative to said first mounting means;

means for adjusting the orientation of said member, comprising a third mounting means for pivotally connecting said adjusting means to said pivot plate means at said third mounting location, said adjusting means being further provided with pin means for pivotally connecting said adjusting means to said member at a location spaced from said third mounting location, whereby said adjusting means interconnects said pivot plate means and the member so that the member pivots about said first mounting location in correspondence with the pivoting of said second mounting means about said first mounting location, said adjusting means being adapted to vary the spacing of said pin means and said third mounting location;

means for pivoting the first boom about the second boom, whereby said pivot means pivots said second mounting means about said first mounting means, and said adjusting means acts to correspondingly pivot the member to maintain its orientation as said second mounting means pivots about said first mounting means;

a hydraulic cylinder operatively connected to the second boom and the fixed support and having a rod, said rod extending and retracting in response to pivoting of the second boom relative to the fixed support; and means for interconnecting the hydraulic cylinder and said adjusting means so that said adjusting means varies the spacing of said pin means and said third mounting location in correspondence with extension and retraction of said rod of said hydraulic cylinder to maintain the orientation of the member.

12. An apparatus as claimed in claim 11, wherein said adjusting means comprises a hydraulic piston having a barrel end and a rod end.

13. An apparatus as claimed in claim 11, wherein said first, second and third mounting means each comprise a pin.

14. An apparatus as claimed in claim 11, further comprising a second pivot plate.

15. An apparatus as claimed in claim 11, wherein said pivot means comprises a link.

16. An apparatus as claimed in claim 11, wherein said means for pivoting the first boom comprises a hydraulic cylinder connected at one end to the second boom and at another end to the first boom.

* * * * *

US004754840B1

REEXAMINATION CERTIFICATE (3101st)

United States Patent [19] [11] B1 4,754,840

MacDonald et al. [45] Certificate Issued Jan. 14, 1997

[54] LEVELING ASSEMBLY FOR WORK PLATFORMS ON ARTICULATING BOOMS

[75] Inventors: Wayne P. MacDonald, McConnellsburg; Jeffery J. Ritz, Warfordsburg, both of Pa.

[73] Assignee: JLG Industries, Inc., McConnellsburg, Pa.

Reexamination Request:
No. 90/004,062, Dec. 22, 1995

Reexamination Certificate for:

| | |
|---|---|
| Patent No.: | **4,754,840** |
| Issued: | **Jul. 5, 1988** |
| Appl. No.: | **105,724** |
| Filed: | **Oct. 7, 1987** |

[51] Int. Cl.[6] ..... B66F 11/00
[52] U.S. Cl. ..... 182/2; 182/141
[58] Field of Search ..... 182/2, 63, 141, 182/148

[56] References Cited

U.S. PATENT DOCUMENTS 3,834,488 9/1974 Grove .

*Primary Examiner*—Alvin Chin-Shue

[57] ABSTRACT

An apparatus for retaining the attitude of a platform on an articulated boom is provided. The apparatus includes master-slave piston cylinders for adjusting the attitude of the platform relative to a reference object. The apparatus further includes a pivot plate defining a triangle having first, second, and third mounting locations with a platform being pivotally mounted to the pivot plates at one mounting location. A piston cylinder is pivotally connected to the pivot plates at a second mounting location and is operatably connected to the platform. A pivot means is pivotally connected to the pivot plate at the third mounting location and, at its other end, is connected to the fixed support about which the articulating boom rotates. Rotation of the articulating boom results in the pivot means pivoting the pivot plate in such a way that the platform is maintained at its preset orientation.

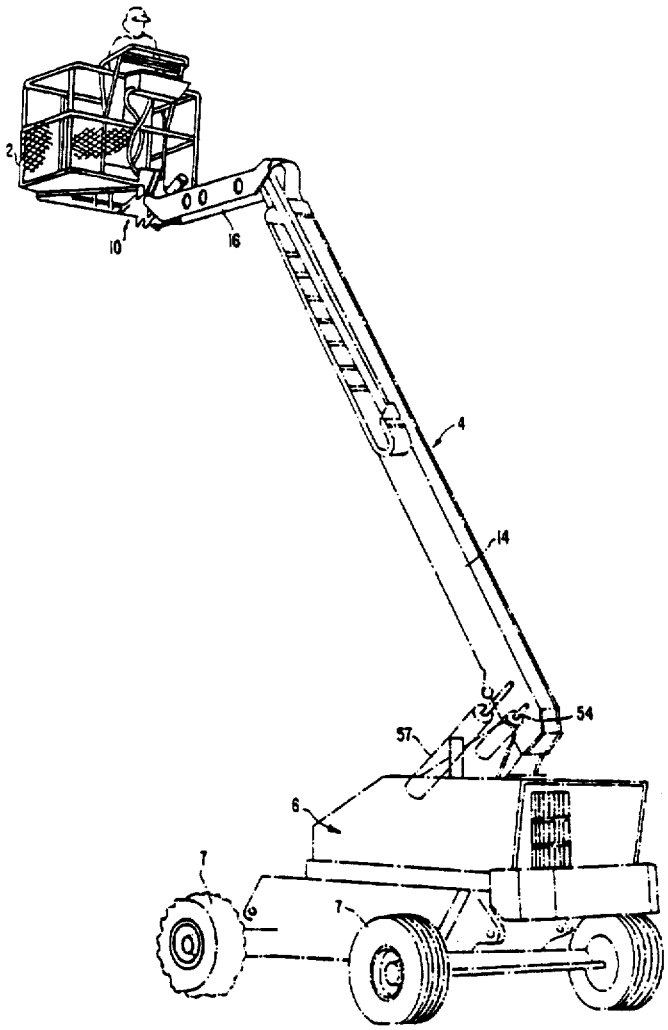

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 11–16 is confirmed.

Claims 1 and 7 are determined to be patentable as amended.

Claims 2–6 and 8–10, dependent on an amended claim, are determined to be patentable.

1. An apparatus for maintaining the orientation of a platform or other elevatable member relative to a fixed support while the member is raised or lowered relative to the fixed support, the member being mounted on a boom which is pivotally connected to the fixed support and has a fly end, comprising:

pivot plate means defining a triangle having first, second and third mounting locations, each mounting location being disposed relatively adjacent a respective corner of said triangle;

a first mounting means for coaxially pivotally mounting said pivot plate means, the fly end of the boom and said member at said first mounting location;

pivot means pivotally connected at one end to said second mounting location by a second mounting means and at another end to the fixed support, said pivot means *and said boom fly end forming a parallelogram linkage and* being adapted to pivot said second mounting means relative to said first mounting means;

means for adjusting the orientation of said member, comprising a third mounting means for pivotally connecting said adjusting means to said pivot plate means at said third mounting location, said adjusting means being further provided with pin means for pivotally connecting said adjusting means to said member at a location spaced from said third mounting location, whereby said adjusting means interconnects said pivot plate means and the member so that the member pivots about said first mounting location in correspondence with the pivoting of said second mounting means about said first mounting location, said adjusting means being adapted to vary the spacing of said pin means and said third mounting location; and means for pivoting the boom about the fixed support, whereby said pivot means pivots said second mounting means about said first mounting means, and said adjusting means acts to correspondingly pivot the member to maintain its orientation as said second mounting means pivots about said first mounting means.

7. A boom assembly for a platform or the like, comprising:

an articulating boom for raising and lowering said platform relative to a fixed support, said boom having a fly end and an opposed end;

pin means for pivotally connecting said opposed end of said boom to said fixed support;

pivot plate means defining a triangle having first, second and third mounting locations, each mounting location being disposed relatively adjacent a respective corner of said triangle;

first mounting means for coaxially pivotally mounting said pivot plate means, the fly end of the boom and said platform at said first mounting location;

pivot means pivotally connected at one end to said second mounting location by a second mounting means and at another end to the fixed support, said pivot means *and said boom fly end forming a parallelogram linkage and* being adapted to pivot said second mounting means relative to said first mounting means;

means for adjusting the orientation of said platform, comprising a third mounting means for pivotally connecting said adjusting means to said pivot plate means at said third mounting location, said adjusting means being further provided with pin means for pivotally connecting said adjusting means to said platform at a location spaced from said third mounting location, whereby said adjusting means interconnects said pivot plate means and the [member] *platform* so that the [member] *platform* pivots about said first mounting location in correspondence with the pivoting of said second mounting means about said first mounting location, said adjusting means being adapted to vary the spacing of said pin means and said third mounting location; and means for pivoting the boom about the fixed support, whereby said pivot means pivots said second mounting means about said first mounting means, and said adjusting means acts to correspondingly pivot the platform to maintain its orientation as said second mounting means pivots about said first mounting means.

* * * * *